US007500645B1

(12) United States Patent
McCubbins

(10) Patent No.: US 7,500,645 B1
(45) Date of Patent: Mar. 10, 2009

(54) REMOVABLE PLAQUE FRAME FOR A LADDER

(75) Inventor: Charles McCubbins, Reno, NV (US)

(73) Assignee: Frame-Rite/Plak-R, LLC, Reno, NV (US)

( * ) Notice: Subject to any disclaimer, the term of this patent is extended or adjusted under 35 U.S.C. 154(b) by 481 days.

(21) Appl. No.: 11/255,600

(22) Filed: Oct. 20, 2005

Related U.S. Application Data

(60) Provisional application No. 60/686,612, filed on Jun. 3, 2005, provisional application No. 60/623,103, filed on Oct. 29, 2004.

(51) Int. Cl.
*E06C 7/14* (2006.01)

(52) U.S. Cl. ..... 248/210; 248/220.21; 248/489

(58) Field of Classification Search ..... 248/446, 248/475.1, 488, 490, 210; 40/606.01, 611.01, 40/661.11, 662, 663, 617, 757; 224/448, 224/547, 558; 182/127, 129
See application file for complete search history.

(56) References Cited

U.S. PATENT DOCUMENTS

| | | | | |
|---|---|---|---|---|
| 4,736,539 | A * | 4/1988 | Dickinson | 40/591 |
| 5,027,537 | A * | 7/1991 | Freeman et al. | 40/210 |
| 5,813,640 | A * | 9/1998 | Koch et al. | 248/222.11 |
| 6,003,922 | A * | 12/1999 | Giesey et al. | 296/37.3 |
| 6,167,645 | B1 * | 1/2001 | Gasko et al. | 40/200 |
| 6,729,053 | B2 * | 5/2004 | Castro | 40/209 |

* cited by examiner

*Primary Examiner*—Gwendolyn Baxter
(74) *Attorney, Agent, or Firm*—Lewis and Roca LLP

(57) ABSTRACT

A removable plaque frame assembly for a ladder comprising: a plaque having a front surface and a back surface, the front surface comprising personalized text; a frame comprising a front surface and a back surface, the back surface comprising an attachment mechanism for securing the plaque to the frame; a recessed tab formed in the back surface of the frame and configured to receive the plaque; an opening formed by the perimeter of the recessed tab, wherein the personalized text may be viewed from the front of the plaque through the opening; a first mounting hook formed in either the front surface or the back surface of the frame; and a second mounting hook formed in the same surface of the frame as the first mounting hook, wherein the second mounting hook is located at a position distal from the first mounting hook.

17 Claims, 8 Drawing Sheets

REMOVABLE PLAQUE FRAME FOR A LADDER

CROSS-REFERENCE TO RELATED APPLICATIONS

This application claims priority to U.S. Provisional Application Ser. No. 60/623,103, filed Oct. 29, 2004, and to U.S. Provisional Application Ser. No. 60/686,612, filed Jun. 3, 2005, which are hereby incorporated by reference as if set forth herein.

BACKGROUND

Field of the Invention

The present invention relates to the personalization of recreational vehicles. More particularly, the present invention relates to a removable plaque frame for the ladder of a recreational vehicle.

SUMMARY

The present invention discloses a new, useful, and nonobvious removable plaque frame that offers users a distinct way of personalizing a recreational vehicle, including, but not limited to, a Class A or Class C motor home, a $5^{th}$ wheel, a travel trailer, or a cab over a camper.

It is an object of the present invention to provide a plaque frame that is removable, adjustable, and that can be assembled easily.

In a preferred embodiment, the present invention comprises a plaque having a front surface and a back surface, the front surface comprising personalized text; a frame comprising a front surface and a back surface, the back surface comprising an attachment mechanism for securing the plaque to the frame; a recessed tab formed in the back surface of the frame and configured to receive the plaque; an opening formed by the perimeter of the recessed tab, wherein the personalized text may be viewed from the front of the plaque through the opening when the plaque is received by the recessed tab and secured to the frame; a first mounting hook formed in either the front surface or the back surface of the frame; and a second mounting hook formed in the same surface of the frame as the first mounting hook, wherein the second mounting hook is located at a position distal from the first mounting hook.

The present invention further comprises a first mounting support configured to rotatably attach to one side of a ladder, the first mounting support comprising a hole configured to receive the first mounting hook; and a second mounting support configured to rotatably attach to another side of the ladder opposite the one side, the second mounting support comprising a hole configured to receive the second mounting hook.

DETAILED DESCRIPTION

Figure 1:
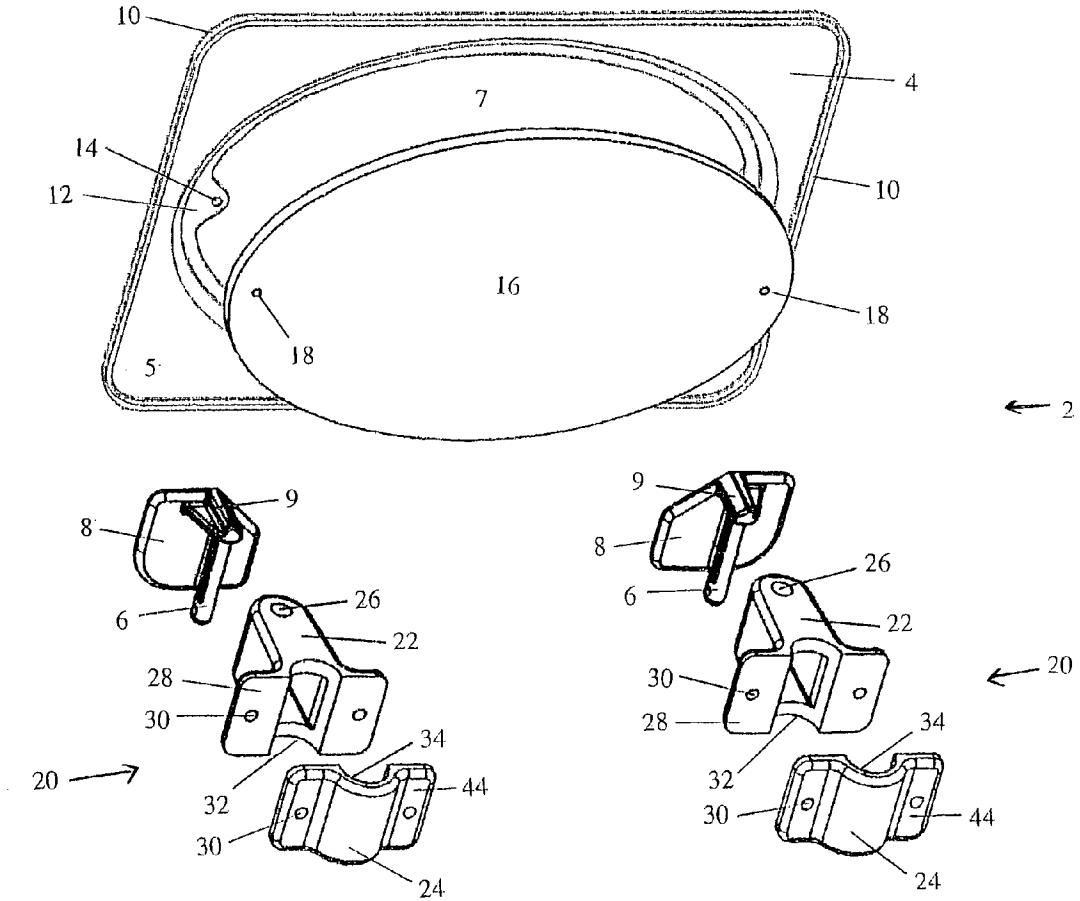
FIG. 1 is an exploded view of a removable plaque frame assembly according to the present invention.

Persons of ordinary skill in the art will realize that the following disclosure is illustrative only and not in any way limiting. Other embodiments of the invention will readily suggest themselves to such skilled persons having the benefit of this disclosure.

FIGS. 1-8 illustrate the removable plaque frame assembly 2 of the present invention with like components being numbered alike. Removable plaque frame assembly 2 comprises frame (or base unit) 4, plaque 16, mounting hooks 6, and mounting supports 20.

Plaque 16 has a front surface and a back surface. The front surface may comprise personalized text (not shown), including, but not limited to a name, message or slogan. The personalized text is preferably located near the center of the front surface of plaque 16.

Frame 4 preferably is substantially rectangular with rounded corners. However, it is contemplated that frame 4 may comprise a variety of different shapes that are suitable for placement on the ladder of a recreational vehicle.

Frame 4 preferably has a width of about 7 to about 11 inches and a height of about 10 to about 15 inches. However, it is contemplated that the dimensions of frame 4 may vary.

Figure 4:
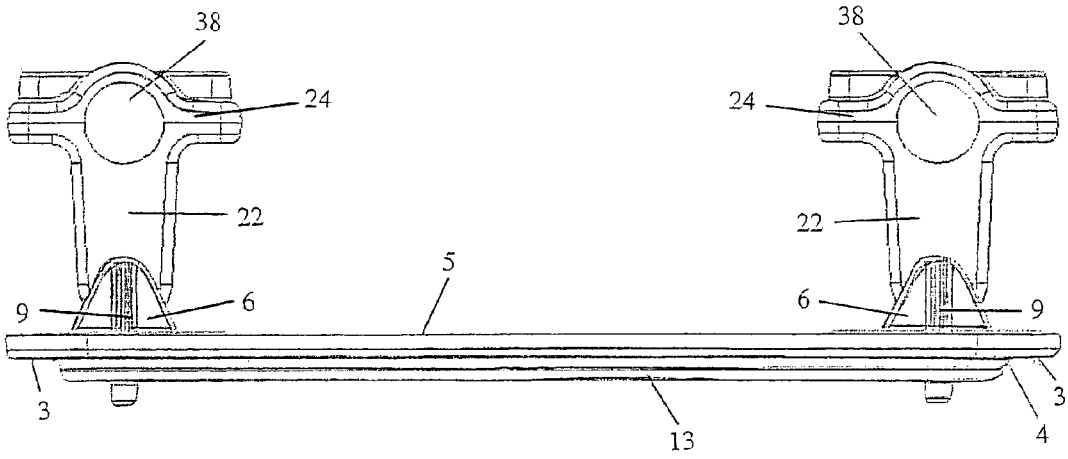
FIG. 4 is a plan view of a removable plaque assembly according to the present invention.
Figure 8:
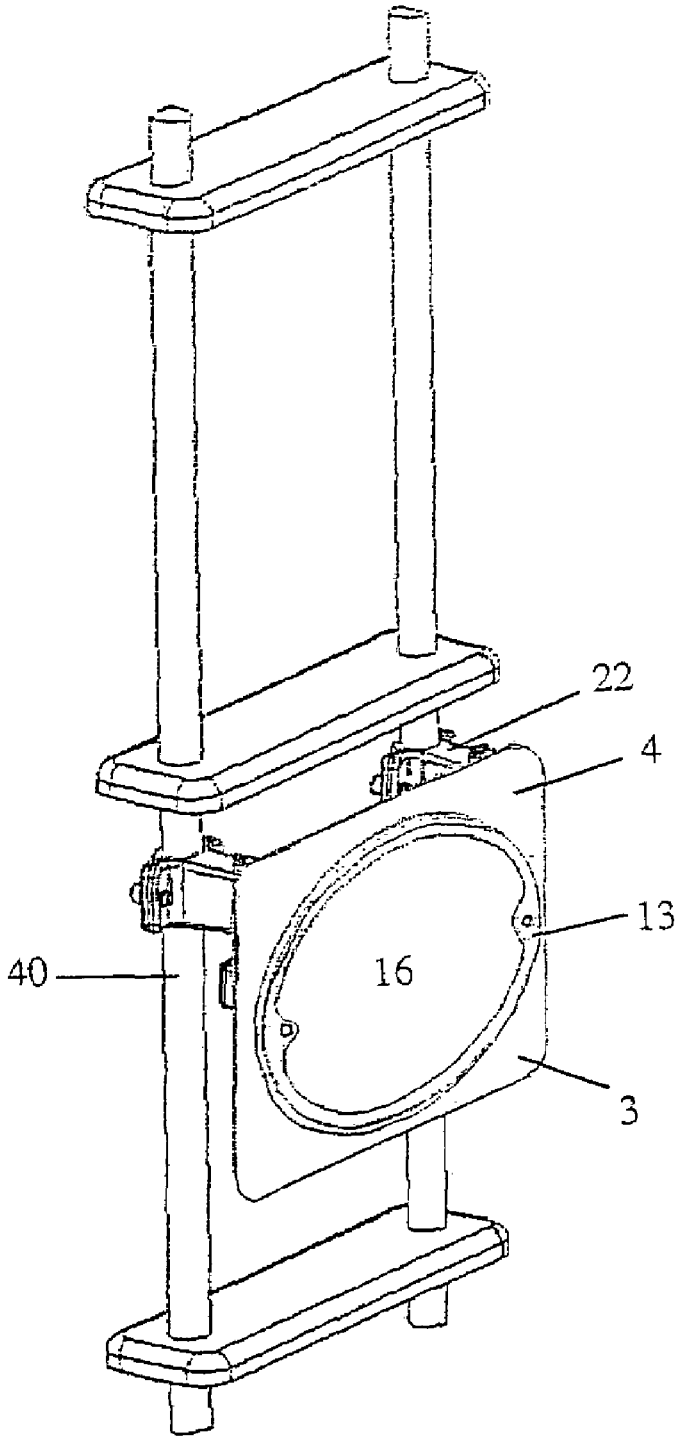
FIG. 8 is a perspective view of a removable plaque frame assembly fully assembled on the outside of a ladder according to the present invention.

Frame 4 comprises front surface 3 and back surface 5. In a preferred embodiment, back surface 5 is a substantially planar surface that leads into recessed tab 12 and opening 7. Recessed tab 12 extends towards opening 7, forming a perimeter around opening 7. Recessed tab 12 is preferably sunken into back surface 5, thereby protruding from front surface 3 in the form of protruding lip 13, as seen in FIGS. 4 and 8. However, it is contemplated that recessed tab 12 may alternatively be sunken into front surface 3 (not shown), thereby protruding from back surface 5 in the form of a protruding lip.

Opening 7 is preferably positioned near the center of frame 4. Recessed tab 12 and opening 7 are configured to receive plaque 16 so that plaque 16 may be viewed through opening 7. In a preferred embodiment, recessed tab 12, opening 7 and plaque 16 all have substantially the same shape. In the exemplary embodiments of FIGS. 1-4 and 6-8, both recessed tab 12 and opening 7 are substantially elliptical in shape. However it is contemplated that recessed tab 12 and opening 7 may comprise a variety of shapes. The shape of recessed tab 12 and opening 7 may be tailored to receive and accommodate the shape of a particular plaque.

Figure 2:
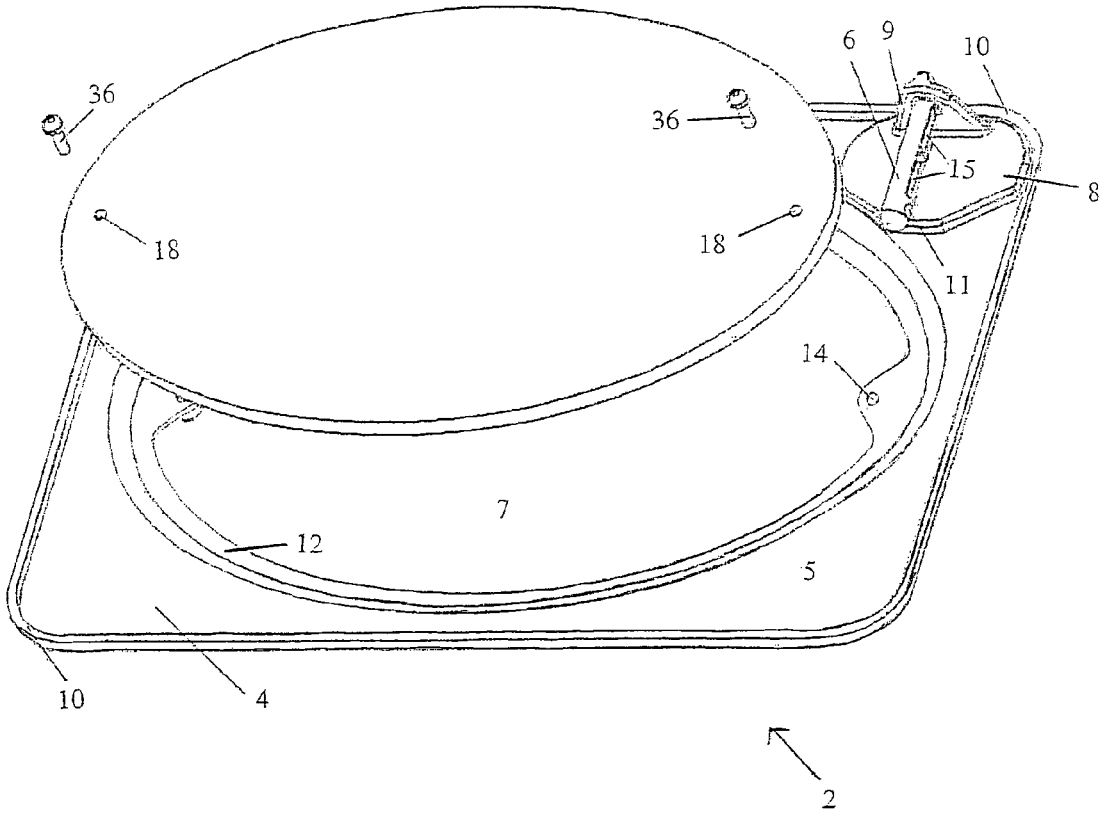
FIG. 2 is another exploded view of a removable plaque frame assembly according to the present invention.

Frame 4 comprises an attachment mechanism for securing plaque 16. In a preferred embodiment, as seen in FIGS. 1 and 2, frame 4 comprises frame holes 14 on recessed tab 12. Frame holes 14 may be placed on a portion of recessed tab 12 that extends out towards opening 7 farther than the rest of recessed tab 12. In the exemplary embodiments illustrated in FIGS. 1 and 2, this portion of recessed tab 12 is substantially triangular with rounded corners. Plaque screw 36 may be placed through plaque holes 18 on plaque 16 and frame holes 14 in order to secure plaque 16 to frame 4. Frame holes 14 may have one open end and one closed end, or two open ends. Frame holes 14 having one open end and one closed end may be threaded for securing plaque screw 36. Frame holes 14 having two open ends may be threaded as well. Additionally, or alternatively, nuts (not shown) may be placed on the end of plaque screws 36 if plaque screws 36 pass all the way through frame holes 14. In a preferred embodiment, frame holes 14 are located on substantially opposite sides of opening 7 in order to provide maximum support for plaque 16. It is contemplated that a variety of different attachment mechanisms may be employed to secure plaque 16 to frame 4 in addition to plaque screws 36.

Frame 4 may also include ridge 10 running along its perimeter and extending away from front surface 3. Ridge 10 may also extend away from back surface 5.

Frame 4 comprises two mounting hooks 6, both of which are located on either front surface 3 or back surface 5. Preferably, the two mounting hooks 6 are spaced apart and positioned near opposite ends of frame 4 so that they may be attached to mounting supports 20 on the sides of ladder 40.

Mounting hooks 6 may comprise any shape that can easily, but securely, fit into hook attachment holes 26 on mounting supports 20. In a preferred embodiment, mounting hooks 6 are substantially tubular and are configured to slide down into a corresponding tubular hook attachment hole 26 in mounting supports 20. Preferably, hook attachment holes 26 have a diameter that is about equal to the diameter of mounting hook 6.

Figure 3:
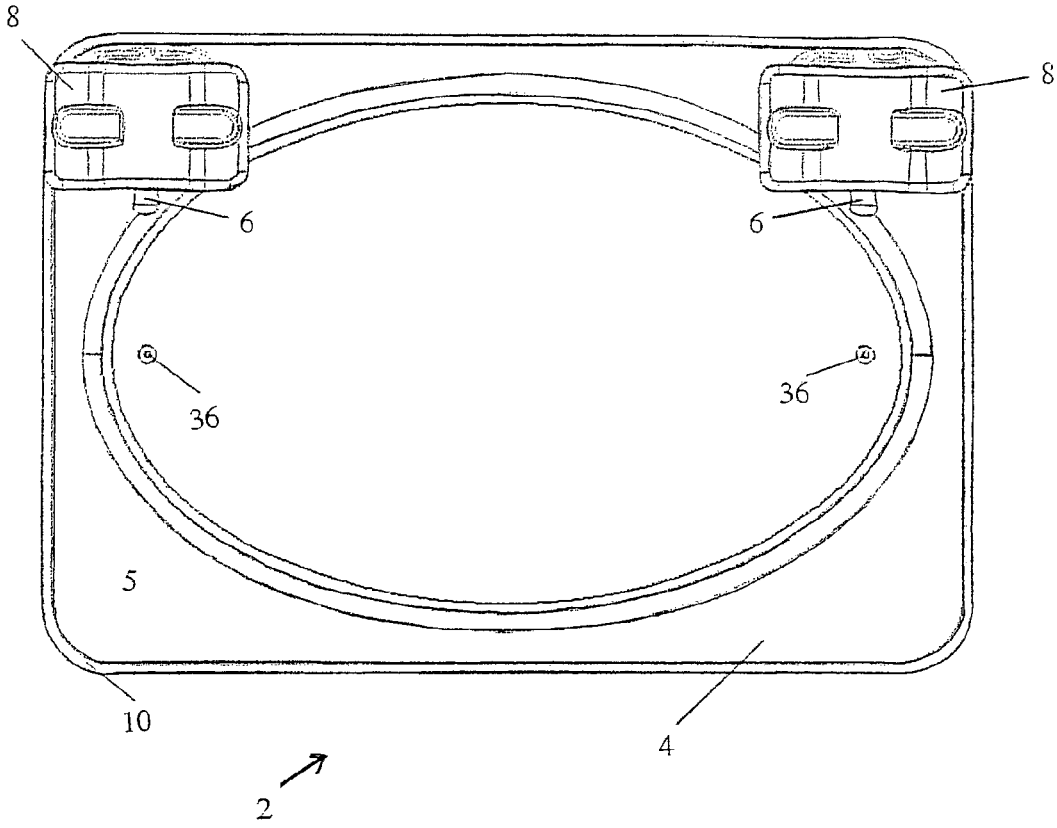
FIG. 3 is a rear view of a removable plaque assembly according to the present invention.
Figure 7:
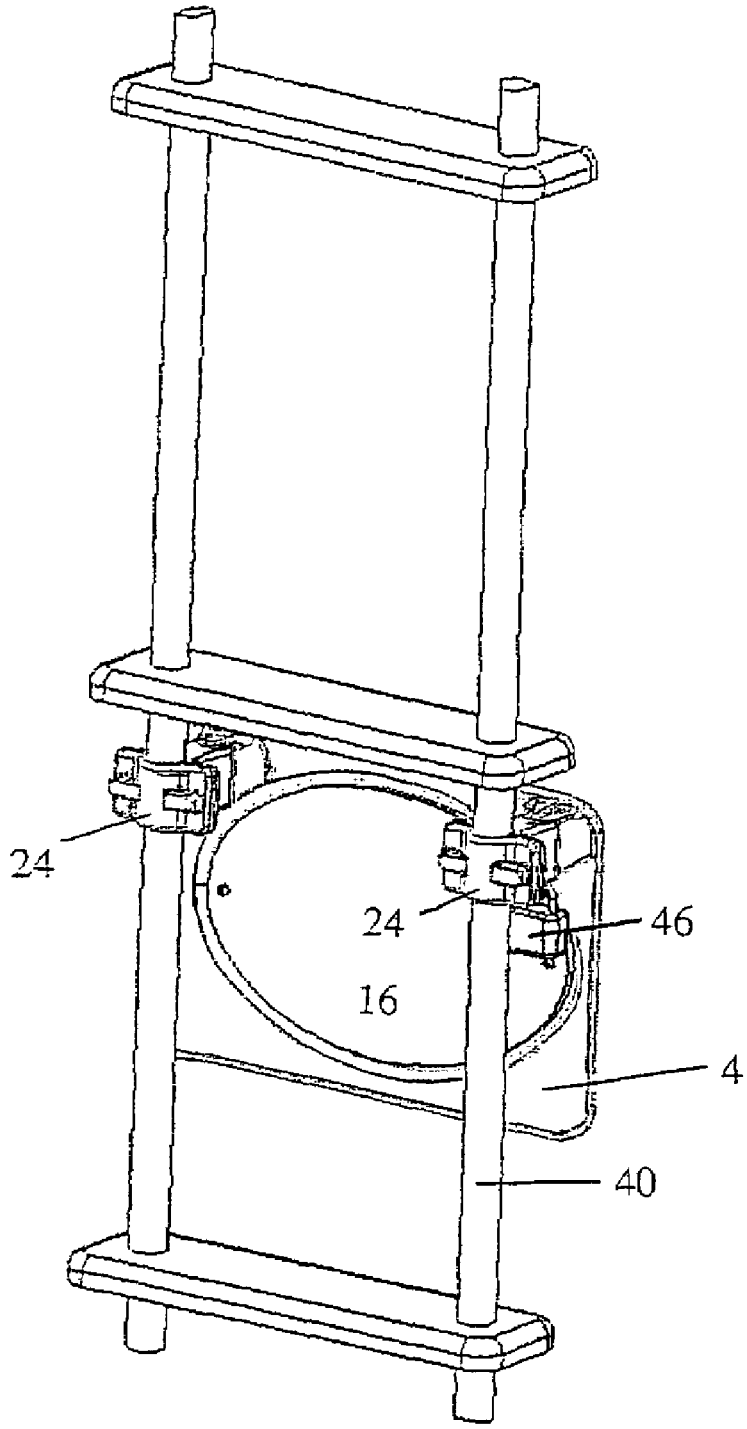
FIG. 7 is a perspective view of a removable plaque frame assembly fully assembled on the inside of a ladder according to the present invention.

As seen in FIG. 2, mounting hooks 6 may comprise slits or canals 15. The bottom of mounting hook 6 may comprise aperture 11 that passes from one side of mounting hook 6 all the way through to the other side of mounting hook 6. As seen in FIG. 3, the bottom of mounting hook 6 may be exposed when mounting hook 6 is slid into hook attachment hole 26. As seen in FIG. 7, a user may place lock 46, such as a padlock, through aperture 11 after mounting hook 6 is placed through hook attachment hole 26, thereby preventing mounting hook 6 from being removed from mounting support 20.

Mounting hook 6 may be connected to mounting hook backing 8. In a preferred embodiment, as seen in FIG. 2, mounting hook 6 and mounting hook backing 8 are integrally formed into frame 4. The length of mounting hook 6 runs substantially parallel to the plane of mounting hook backing 8, front surface 3 and back surface 5. Mounting hook 6 may be connected to mounting hook backing 8 by arm 9 that is substantially perpendicular to mounting hook 6 and mounting hook backing 8, thereby providing space between mounting hook 6 and mounting hook backing 8 so that mounting hook 6 may slide into hook attachment hole 26 and arm 9 can rest on the top of mounting support 20.

Figure 6:
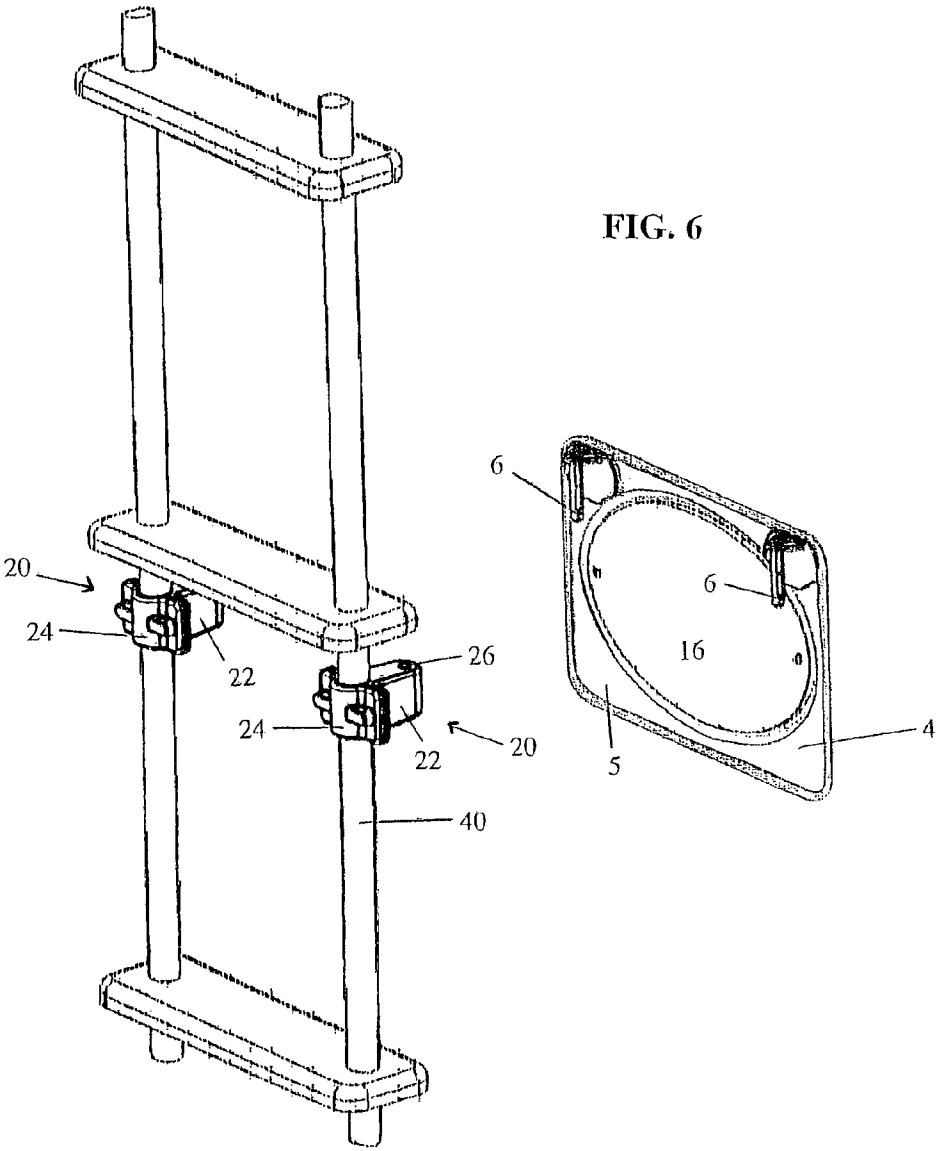
FIG. 6 is a perspective view of a removable plaque frame assembly partially assembled on the inside of a ladder according to the present invention.

As seen in FIGS. 2-4 and 8, mounting hooks 6 may be located on back surface 5 so that frame 4 may be placed on the outside of ladder 40. However, it is contemplated that mounting hooks 6 may alternatively be located on front surface 3 so that frame 4 may be placed on the inside of ladder 40, as seen in FIGS. 6 and 7. Placing frame 4 on the inside of ladder 40 allows the user to climb ladder 40 without obstruction while still displaying plaque 16.

Mounting support 20 is configured to removably attach to the side of a ladder 40 on a recreational vehicle and to accommodate the attachment of mounting hook 6. In a preferred embodiment, mounting support 20 comprises hook attachment component 22 and ladder attachment component 24.

Hook attachment component 22 comprises hook attachment hole 26 at one end that is configured to receive mounting hook 6, as previously mentioned. At an opposite end, hook attachment component 22 comprises arcuate surface 32 with attachment tabs 28 positioned on opposite sides of arcuate surface 32. The distance between hook attachment hole 26 and arcuate surface 32 is preferably at least about one inch. Arcuate surface 32 is bowed like a semi-circle towards the end having hook attachment hole 26. Attachment tabs 28 preferably comprise a substantially planar surface having an attachment means, such as mounting support hole 30, for securing hook attachment component 22 to ladder attachment component 24.

Ladder attachment component 24 comprises arcuate surface 34 with attachment tabs 44 positioned on opposite sides of arcuate surface 34. Arcuate surface 34 is bowed like a semi-circle. Attachment tabs 44 preferably comprise a substantially planar surface having an attachment means, such as mounting support hole 30, for securing ladder attachment component 24 to hook attachment component 22.

Mounting support holes 30 may be threaded so as to securely receive and hold mounting support screws 42. Hook attachment component 22 and ladder attachment component 24 may be coupled together by placing mounting support screws 42 through mounting support holes 30 on both hook attachment component 22 and ladder attachment 24.

When hook attachment component 22 and ladder attachment component 24 are placed together so that attachment tabs 28 and mounting support holes 30 on hook attachment component 22 are aligned with attachment tabs 44 and mounting support holes 30 on ladder attachment component 24, arcuate surface 32 and arcuate surface 34 are bowed in opposite directions, forming a hollow and circular mounting support interior 38, as seen in FIG. 4. Mounting support interior 38 is configured to receive one side of ladder 40 and to allow mounting support 20 to rotate about ladder 40. Since mounting supports 20 may be rotated, they can accommodate a variety of ladders with different widths while still aligning hook attachment holes 26 with mounting hooks 6.

Figure 5:
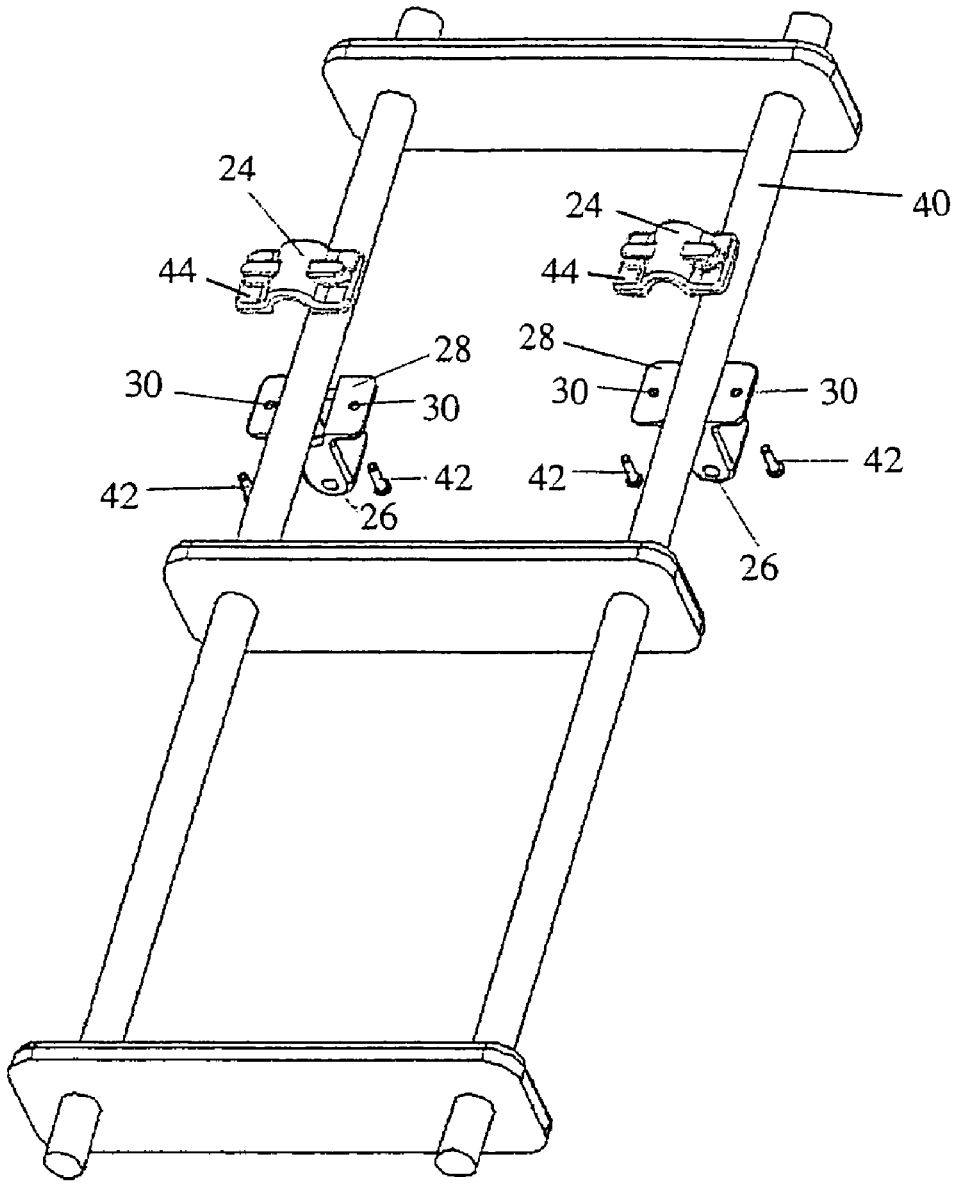
FIG. 5 is an exploded view of a removable plaque frame assembly and a ladder according to the present invention.

When installing removable plaque frame assembly 2, the user first selects the proper height to display plaque 16 on ladder 40, as seen in FIG. 5. Mounting supports 20 are then placed on both sides of ladder 40 by aligning attachment tabs 28 and mounting support holes 30 on hook attachment component 22 with attachment tabs 44 and mounting support holes 30 on ladder attachment component 24, and gently tightening mounting support screws 42 so that mounting support 20 remains at the selected height without slipping. As seen in FIG. 6, the side of ladder 40 runs through mounting support interior 38 formed by arcuate surfaces 32 and 34, which are bowed in opposite directions. Mounting supports 20 may be positioned so that hook attachment holes 26 are on the inside of ladder 40 (i.e., the side closest to the recreational vehicle). This configuration accommodates a frame 4 having mounting hooks 6 on front surface 3, as in FIG. 6. Alternatively, mounting supports 20 may be positioned so that hook attachment holes 26 are on the outside of ladder 40 (i.e., the side farthest away from the recreational vehicle). This configuration accommodates a frame 4 having mounting hooks 6 on back surface 5, as in FIG. 8.

Plaque 16 may then be screwed, or otherwise attached, to frame 4 so that the personalized text on plaque 16 is visible to someone looking at front surface 3. It is contemplated that plaque 16 may also be attached to frame 4 before mounting supports 20 are attached to ladder 40.

Frame 4 is then attached to mounting supports 20 by placing mounting hooks 6 into hook attachment holes 26. Slight adjusting of mounting supports 20 may be required so that mounting hooks 6 are properly aligned with and slide all the way into hook attachment holes 26. Mounting support screws 42 may then be tightened, preventing any movement from mounting supports 20. Frame 4 may be removed from mounting supports 20 prior to tightening mounting support screws 42 so as to allow for easier access.

Once mounting support screws 42 are securely tightened, mounting hooks 6 on frame 4 may be slid back into hook attachment holes 26. As previously mentioned, lock 46 may be placed through aperture 11 at the bottom of mounting hook 6 in order to prevent frame 4 from being removed from mounting support 20 and ladder 40, as seen in FIG. 7.

In an additional embodiment not shown, frame 4 may comprise an adhesive, such as tape, on either front surface 3 or back surface 5 for securing frame 4 to a substantially flat surface, such as the back wall of a recreational vehicle.

In a preferred embodiment, frame 4, mounting hooks 6 and mounting supports 20 are made of high grade ABS (Acrylonitrile Butadiene Styrene) composites and have UV inhibitors added to them. However, it is contemplated that a variety of different materials may be used to form the components of removable plaque frame assembly 2.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A removable plaque frame assembly for a ladder comprising:

a plaque having a front surface and a back surface, said front surface comprising personalized text;

a frame comprising a front surface and a back surface, said back surface comprising an attachment mechanism for securing said plaque to said frame;

a recessed tab formed in said back surface of said frame and configured to receive said plaque;

an opening formed by the perimeter of said recessed tab, wherein said personalized text may be viewed from the front of said plaque through said opening when said plaque is received by said recessed tab and secured to said frame;

a first mounting hook formed in either said front surface or said back surface of said frame; and a second mounting hook formed in the same surface of said frame as said first mounting hook, wherein said second mounting hook is located at a position distal from said first mounting hook;

a first mounting support configured to rotatably attach to one side of a ladder, said first mounting support comprising a hole configured to receive said first mounting hook; and a second mounting support configured to rotatably attach to another side of said ladder opposite said one side, said second mounting support comprising a hole configured to receive said second mounting hook.

2. The removable plaque frame assembly of claim 1, wherein said first mounting hook and said second mounting hook are formed in the front surface of said frame.

3. The removable plaque frame assembly of claim 1, wherein said first mounting hook and said second mounting hook are formed in the back surface of said frame.

4. The removable plaque frame assembly of claim 1, wherein:

said first and said second mounting supports each comprise a first component and a second component;

said first component having said hole at one end and an arcuate surface at an opposite end, said opposite end having a first attachment tab on one side of said arcuate surface and a second attachment tab on the opposite side of said arcuate surface, said first and said second attachment tabs each comprising a threaded hole configured to receive a screw; and said second component having an arcuate surface, a first attachment tab on one side of said arcuate surface and a second attachment tab on the opposite side of said arcuate surface, said first and said second attachment tabs each comprising a threaded hole configured to receive a screw.

5. The removable plaque frame assembly of claim 4, wherein:

said first component and said second component of said first mounting support are coupled to one another around one side of said ladder, and said first component and said second component of said second mounting support are coupled to one another around another side of said ladder opposite said one side.

6. The removable plaque frame assembly of claim 5 wherein said first attachment tab and threaded hole of said first component of said first mounting support are aligned with said first attachment tab and threaded hole of said second component of said first mounting support, said second attachment tab and threaded hole of said first component of said first mounting support are aligned with said second attachment tab and threaded hole of said second component of said first mounting support, and said arcuate surface of said first component of said first mounting support is bowed in an opposite direction as said arcuate surface of said second component of said first mounting support, forming a circular interior that receives said one side of said ladder, and said first attachment tab and threaded hole of said first component of said second mounting support are aligned with said first attachment tab and threaded hole of said second component of said second mounting support, said second attachment tab and threaded hole of said first component of said second mounting support are aligned with said second attachment tab and threaded hole of said second component of said second mounting support, and said arcuate surface of said first component of said second mounting support is bowed in an opposite direction as said arcuate surface of said second component of said second mounting support, forming a circular interior that receives said another side of said ladder.

7. The removable plaque frame assembly of claim 6, wherein said first component and said second component of said first mounting support and said first component and said second component of said second mounting support are coupled together using screws, said screws being placed through corresponding threaded holes on said first and second component of said first mounting support and said first and second component of said second mounting support.

8. The removable plaque frame assembly of claim 5, wherein said ladder is a ladder on a recreational vehicle.

9. The removable plaque frame assembly of claim 1, wherein said frame is substantially rectangular with rounded corners.

10. The removable plaque frame assembly of claim 9, wherein said frame has a width of about 7 to about 11 inches and a height of about 10 to about 15 inches.

11. The removable plaque frame assembly of claim 10, wherein said recessed plaque is substantially elliptical.

12. The removable plaque frame assembly of claim 1, wherein said recessed tab and said opening are substantially elliptical.

13. The removable plaque frame assembly of claim 1, wherein said recessed tab, said opening and said plaque have substantially the same shape.

14. The removable plaque frame assembly of claim 1, wherein said attachment mechanism for securing said plaque to said frame comprises two threaded holes, said two threaded holes each configured to securely receive a screw.

15. The removable plaque frame assembly of claim 14, wherein said two threaded holes are located on said recessed tab.

16. The removable plaque frame of claim 15, wherein said two threaded holes are located on substantially opposite sides of said opening.

17. The removable plaque frame of claim 1, wherein said recessed tab is sunken into said back surface of said frame, thereby protruding from said front surface of said frame in the form of a protruding lip.

* * * * *